United States Patent [19]

Kato et al.

[11] 4,252,895

[45] Feb. 24, 1981

[54] PHOTODEVELOPABLE SILVER HALIDE PHOTOSENSITIVE MATERIAL

[75] Inventors: Masahiro Kato; Shoichiro Sumi; Shoji Iwata, all of Tokyo, Japan

[73] Assignee: Oriental Photo Industrial Co., Ltd., Tokyo, Japan

[21] Appl. No.: 62,500

[22] Filed: Jul. 31, 1979

[30] Foreign Application Priority Data

Aug. 7, 1978 [JP] Japan ..... 53/95907

[51] Int. Cl.[3] ..... G03C 1/28; G03C 1/34

[52] U.S. Cl. ..... 430/591; 430/592; 430/611; 430/616; 430/564; 430/600

[58] Field of Search ..... 430/591, 592, 611, 616, 430/564, 600

[56] References Cited

U.S. PATENT DOCUMENTS

| | | | |
|---|---|---|---|
| 3,241,971 | 3/1966 | Kitze | 430/616 |
| 3,579,348 | 5/1971 | Fix | 430/616 |

*Primary Examiner*—Won H. Louie, Jr.

*Attorney, Agent, or Firm*—Blanchard, Flynn, Thiel, Boutell & Tanis

[57] ABSTRACT

A photodevelopable silver halide photosensitive material wherein a visible image is formed by a latent image-forming step in which high illumination exposure is effected for a short time and a subsequent light development step in which low illumination exposure is effected, which comprises at least one compound of the formula:

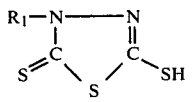

(I)

wherein $R_1$ is hydrogen, lower alkyl or a substituted or unsubstituted aryl group and salts thereof.

19 Claims, No Drawings

PHOTODEVELOPABLE SILVER HALIDE PHOTOSENSITIVE MATERIAL

The present invention relates to a photodevelopable silver halide photosensitive material. More particularly, the present invention relates to an photodevelopable silver halide photosensitive material suitable for oscillographic recording.

Silver halide photosensitive materials of the printing-out type are known and are in practical use. Various forms of print-out type photosensitive materials are commercially available. Unlike ordinary photosensitive materials used in the wet-processing technique wherein a liquid development process is employed, the known print-out type photosensitive materials are those used in the dry-processing technique wherein development is effected by means of light. Those photosensitive materials are used widely, particularly in the oscillographic recording field, because of the simplicity of the treatment thereof as compared with the wet process.

Generally, photodevelopable silver halide photosensitive materials form a latent image caused by high illumination exposure for a short time. Thereafter, the latent image thus formed is intensified by low illumination exposure for a relatively long time to convert the latent image into a visible image. The exposure for forming the latent image is effected for a short time of less than 1 second, preferably for $10^{-1}$ to $10^{-6}$ second, by using a light source having a light energy of a high intensity, such as ultra-high pressure mercury lamp, tungsten lamp, xenon flash, halogen lamp, arc lamp, flying-spot of fluorescent substance of cathode ray tube or laser beam.

In the exposure for intensifying the latent image or converting the same into a visible image, a light energy of an illumination as low as 250–1000 lux is utilized. The exposure is effected for a long time period of more than about 1 second with a light source selected from those of 250–1000 lux, such as luminescent lamp, reflected natural light, tungsten lamp and black light. Usually, this exposure is called "light development".

When such a photodevelopable silver halide photosensitive material is used, substantially no image can be formed when the latent image-forming exposure is effected with a light of low illumination. This is different from a photosensitive material as used in old-time printing-out super wherein a visible image is formed by energy obtained by continuous irradiation with the same light source.

As described above, the photodevelopable silver halide photosensitive material is advantageous in that it can be treated in a dry system. However, it has the disadvantage that it has a low development efficiency. Therefore, various halogen acceptors for improving the development efficiency have been proposed. For example, there have been known inorganic compounds as disclosed in Japanese Patent Publications Nos. 9975/1960, 9395/1960, 15885/1961, 1702/1965, 25745/1964 and 1700/1965 and organic compounds disclosed in Japanese Patent Publications Nos. 11502/1964, 18647/1967, 23882/1967 and 25225/1970. It has also been known to use a metal salt of dithiocarbamic acid as disclosed in Japanese Patent Publication No. 15819/1974.

However, those compounds used as a halogen acceptor cannot afford a satisfactory light-developing property. For example, a halogen acceptor which affords a high sensitivity causes severe fogging, and another halogen acceptor which minimizes fogging also causes reduction in the sensitivity and maximum density. Further, the conventional light developers have the disadvantage that the amount thereof required for obtaining an intended image density is very large due to their poor light-developing effect and, consequently, the stability thereof may be reduced with time or the background may be colored.

On the other hand, in a conventional electromagnetic oscillographic device of the direct recording type, an ultra-high pressure mercury lamp is used as the light source for forming a latent image. However, since a high voltage is used in the lighting circuit, the handling thereof is dangerous or the quantity of light required for the exposure cannot be obtained unless the exposure is effected for a relatively long period of time. Further, a long time is required for lighting it again after it is once put out. In addition, the mercury vapor contained in the mercury lamp is highly poisonous and, therefore, the effect thereof on human bodies, etc., when it is broken, should be taken into consideration.

Under the circumstances as described above, high illumination tungsten lamps, xenon lamps, and halogen lamps are used as light sources for the electromagnetic oscillographic device of the direct recording type. A light source device comprises a combination of said high intensity light source and a high speed shutter. Those light sources have spectral properties on the longer wavelength side compared to the inherent sensitive wave ranges of silver halides. Therefore, a silver halide photosensitive material to be used in the exposure, when such a light source is used, should have a high spectral sensitivity which coincides with said longer wavelength range. An image thus obtained should have a satisfactory contrast while fog is controlled sufficiently and, in addition, the image should be free of or substantially free of residual coloring due to the sensitizing dye.

Photodevelop the silver halide photosensitive materials having a spectral sensitivity on the relatively long wavelength side and to which a sensitizing dye is applicable, have been disclosed in, for example, U.S. Pat. Nos. 3,287,136, 3,364,032, 3,486,901 and 3,579,348. However, those photosensitive materials still have insufficient spectral sensitivity to a light source having spectral properties on the relatively long wavelength side, such as a tungsten lamp, and fog formation is a serious unfavorable defect. Further, it has been known that said ordinary halogen acceptor deteriorate the spectral sensitivity of a photosensitive material sensitized with said sensitizing dye, particularly merocyanine dye, and cause a reduction in the maximum density. It has been unexpected, therefore, that an improved high spectral sensitivity can be obtained and fog formation can be controlled by the combination of a selected special halogen acceptor and a selected special sensitizing dye.

An object of the present invention is to provide an improved photodevelopable silver halide photosensitive material the and which is free of said defects.

Another object of the present invention is to provide a silver photodevelopable silver halide photosensitive material having an improved spectral sensitivity.

Still another object of the present invention is to provide a photodevelopable silver halide photosensitive material which controls fog formation without deteriorating the improved high spectral sensitivity.

A further object of the present invention is to provide a photodevelopable silver halide photosensitive material with which contrast reduction due to the residual coloring of the sensitizing dye is eliminated.

Another object of the present invention is to provide a photodevelopable silver halide photosensitive material in which a reduction in the maximum density does not occur.

The objects of the present invention can be attained by using a photodevelopable silver halide photosensitive material containing one or a mixture of compounds of the formula:

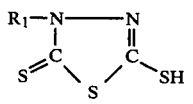

(I)

wherein $R_1$ is hydrogen, lower alkyl, preferably lower alkyls having 1 to 5 carbon atoms such as methyl, ethyl or n- or t-amyl, substituted or unsubstituted aryl, such as phenyl, tolyl, chloro-phenyl and nitrophenyl, and salts thereof, as a halogen acceptor, in at least one of the structural elements thereof, such as the silver halide photographic emulsion layer or the nonsensitive binder layer adjacent to the silver halide emulsion layer.

In a preferred embodiment of the present invention, the photodevelopable silver halide photosensitive material contains one or a mixture of halogen acceptors developers of the above formula (I) and one or a mixture of sensitizing dyes having the formula (II) in a structural element thereof:

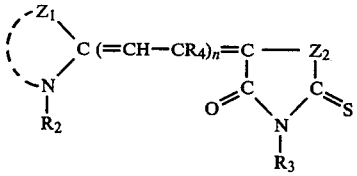

(II)

wherein $Z_1$ is a non-metal atomic group necessary for forming a five-membered or six-membered heterocyclic ring, such as benzoxazole ring, benzothiazole ring, benzoselenazole ring, naphthoxazole ring, naphthothiazole ring, naphthoselenazole ring, oxazole ring, thiazole ring, indole ring, and 2-quinoline. The heterocyclic rings also include those having substituents such as 4-chlorobenzothiazole, 5-chlorobenzothiazole, 6-chlorobenzothiazole, 5-bromobenzothiazole, 6-bromobenzothiazole, 5-iodobenzothiazole, 6-iodobenzothiazole, 5-chlorobenzoxazole, 5-bromobenzoxazole, 5-chlorobenzoselenazole, 4-methylthiazole, 5-methylthiazole, 4-methylbenzothiazole, 5-methylbenzothiazole, 6-methylbenzothiazole, 5-methylbenzoxazole, 6-methylbenzoxazole, 4-methyloxazole, 5-methyloxazole, 3,3-dimethylindole, 4-methoxybenzothiazole, 5-methoxybenzothiazole, 4-ethoxybenzothiazole, 5,6-dimethoxybenzothiazole, naphtho[1,2-d]thiazole, 5-methoxynaphtho[1,2-b]thiazole, 5-ethoxynaphtho[1,2-d]thiazole, 8-methoxynaphtho[1,2-d]thiazole, 7-methoxynaphtho[1,2-d]thiazole, naphtho[b 1,2-d]oxazole, 5-methoxybenzoxazole, 6-methoxybenzoxazole, 5-methoxybenzoselenazole, 5-hydroxybenzothiazole, 6-hydroxybenzothiazole, 5-hydroxybenzoxazole, 6-hydroxybenzoxazole, 5-hydroxybenzoselenazole, 5-phenylthiazole, 4,5-diphenylthiazole, 5-phenylbenzothiazole, 6-phenylbenzothiazole, 5-phenylbenzoxazole, 5-phenylthiazole, 4-phenyloxazole and 4-(2-thienyl)-thiazole. $Z_2$ in the above formula represents either sulfur or $>NR_5$, wherein $R_5$ is hydrogen; a substituted or unsubstituted alkyl, such as methyl, ethyl, n-propyl, iso-propyl, t-amyl, n-hexyl, n-octyl, carboxymethyl, 2-carboxyethyl, 3-carboxypropyl, 4-carboxybutyl, 3-carboxybutyl, 2-sulfoethyl, 3-sulfopropyl, 3-sulfobutyl or 2-dimethylaminoethyl; or unsubstituted or substituted aryl, such as phenyl, tolyl, chloro-phenyl, methoxyphenyl and carboxy-phenyl.

$R_2$ and $R_3$ each represent a substituted or unsubstituted alkyl (concrete examples of which are the same alkyls as defined for $R_5$) or $R_3$ can be hydrogen, aryl, substituted aryl, such as phenyl, naphthyl, tolyl, chloro-phenyl, methoxy-phenyl and carboxy-phenyl, or alkenyl, such as allyl group. When $R_2$ and/or $R_3$ represent sulfoalkyl or carboxyalkyl, it also includes alkali metal salts, such as sodium salt or potassium salt, quaternary ammonium salts and organic amine salts thereof. $R_2$ also may be substituted aryl.

$R_4$ is hydrogen, alkyl having 1 to 5 carbon atoms, or substituted aryl, such as phenyl and carboxyphenyl. n is a number of 0, 1 or 2.

As salts of compounds of the above formula (I), there can be mentioned alkali metal salts, such as sodium salts and potassium salts, ammonium salts and organic amine salts, such as 1,8-diazabicyclo[5,4,0]undecene-7 salts and lutidine salts. When $R_1$ in the compounds of the above formula (I) represents hydrogen, the compounds are the following tautomers:

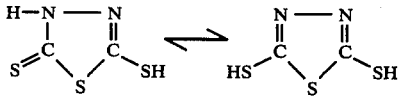

(2,5-dimercapto-1,3,4-thiadiazole)

Therefore, the salts of 2,5-dimercapto-1,3,4-thiadiazole include both monosalts and disalts thereof.

2,5-Dimercapto-1,3,4-thiadiazole is a known compound and can be synthesized easily. It is also readily available on the market at a low cost. Compounds of the above formula in which $R_1$ represents alkyl or aryl are also known compounds and can be easily synthesized. Further, those compounds have a considerable acid strength and, therefore, they can be synthesized easily in the form of their alkali metal salts, ammonium salts or organic amine salts by a customary method and purification thereof is also relatively easy. As compared with 2,5-dimercapto-1,3,4-thiadiazoles, which are poorly soluble in water and, therefore, are usually used in the form of a solution thereof in an organic solvent, such as methanol, ethanol or dimethylformamide, the salts are capable of substantially increasing the solubility of 2,5-dimercapto-1,3,4-thiadiazole in water. Therefore, they can be incorporated easily in the structural elements of the photographic material and precipitation thereof can be prevented. Thus, they can be conveniently used. If 2,5-dimercapto-1,3,4-thiadiazole is used in the form of a salt thereof, the light development effect becomes greater and the sensitivity is improved favorably.

Typical examples of the halogen acceptors are given below, which by no means limit the present invention.

Compounds (1) 2,5-Dimercapto-1,3,4-thiadiazole, (2) Monosodium salt of 2,5-dimercapto-1,3,4-thiadiazole,
(3) Dipotassium salt of 2,5-dimercapto-1,3,4-thiadiazole,
(4) Monoammonium salt of 2,5-dimercapto-1,3,4-thiadiazole,
(5) Mono(1,8-diazabicyclo[5,4,0]undecene-7) salt of 2,5-dimercapto-1,3,4-thiadiazole,
(6) Bis(1,8-diazabicyclo[5,4,0]undecene-7) salt of 2,4-dimercapto-1,3,4-thiadiazole,
(7) Monolutidine salt of 2,5-dimercapto-1,3,4-thiadiazole,
(8) 3-ethyl-5-mercapto-1,3,4-thiadiazole-2-thione,
(9) Potassium salt of 3-phenyl-5-mercapto-1,3,4-thiadiazole-2-thione, and
(10) Potassium salt of 3-methyl-5-mercapto-1,3,4-thiadiazole-2-thione.

Compounds of above general formula (I) and salts thereof used in the present invention can be contained in the silver halide photographic emulsion layer in a wide range of concentration. They can usually be used in a small amount of 0.1–10 molar %, preferably 0.3–2 molar %, based on the amount of silver halide contained therein.

When salts of the compounds used in the present invention are incorporated in a structural element of the photosensitive material, they can be used in the form of an aqueous solution. On the other hand, when the compounds, not in the form of salts, are to be incorporated therein, they can be used in the form of a solution in an organic solvent, such as methanol, ethanol, acetone or dimethylformamide. Further, they can be used in the form of an aqueous alkali solution obtained by dissolving them in potassium hydroxide solution or sodium hydroxide solution. They can be incorporated therein at any time during the preparation. Preferably, they are incorporated directly before the application of an emulsion.

Alternatively, they can be incorporated therein by immersion in a solution containing a compound or salt thereof used in the present invention after the application and then drying.

Typical examples of sensitizing dyes of the formula (II) used in the present invention are given below, which by no means limit the present invention:

Typical examples

Dye Nos.

(1)

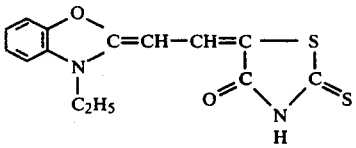

(2)

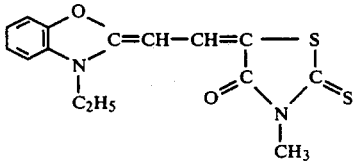

(3)

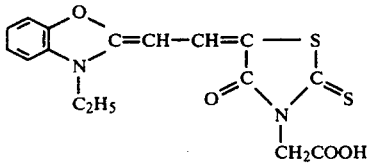

-continued (4)

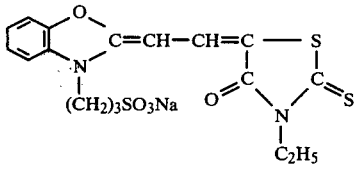

(5)

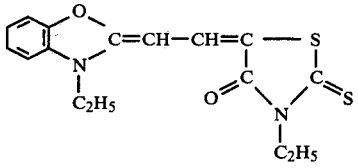

(6)

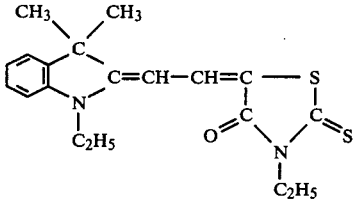

(7)

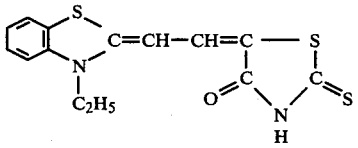

(8)

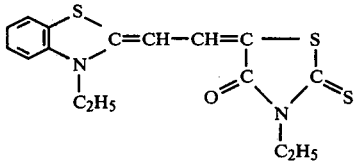

(9)

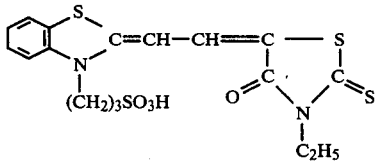

(10)

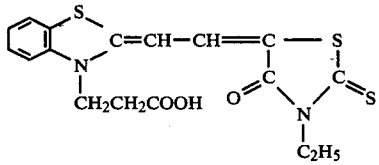

(11)

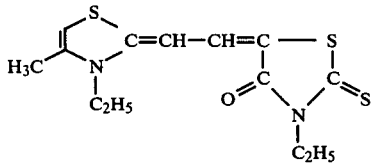

(12)

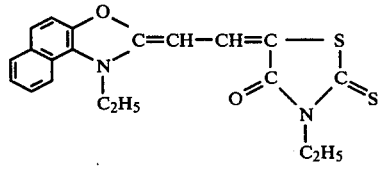

(13)

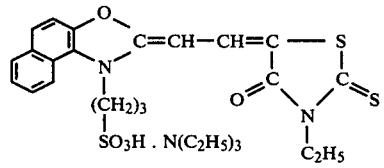

-continued (14)

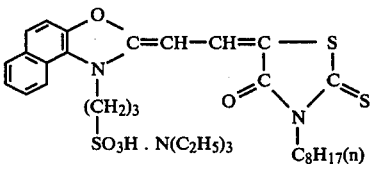

(15)

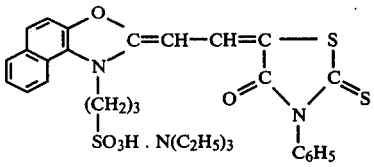

(16)

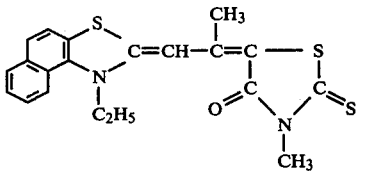

(17)

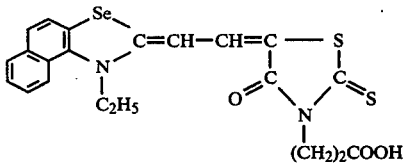

(18)

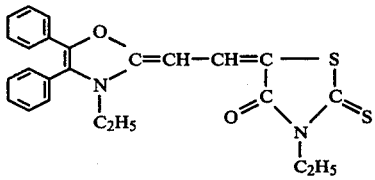

(19)

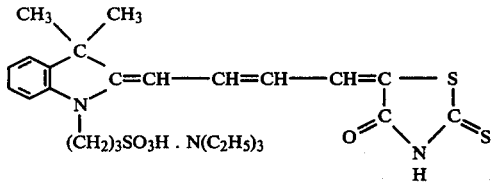

(20)

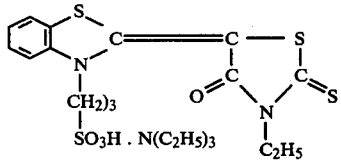

(21)

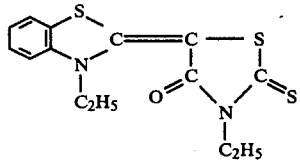

(22)

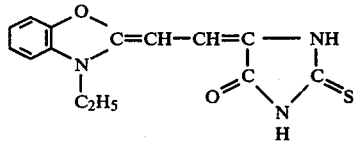

(23)

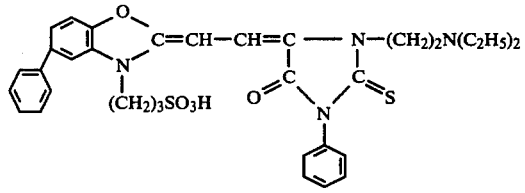

-continued (24)

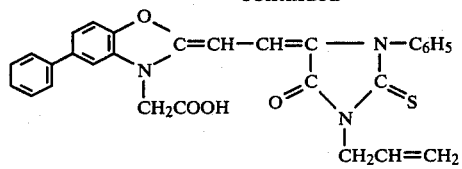

(25)

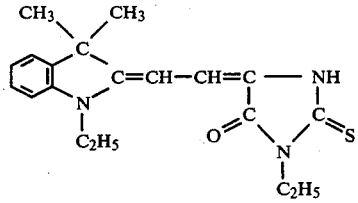

(26)

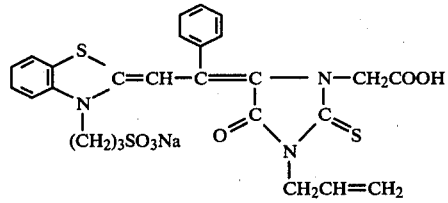

(27)

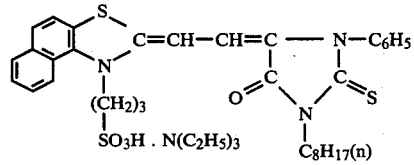

(28)

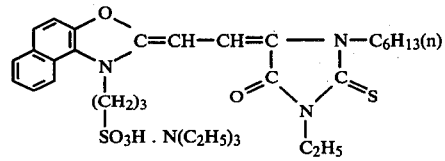

Those sensitizing dyes and processes for the preparation thereof are described in, for example, Frances M. Hamer, "The Cyanine Dyes and Related Compounds" (1964) published by Interscience Publishers, pp. 511-611.

The sensitizing dyes of the present invention are used generally in an amount of about 10-1,000 mg, preferably 100-300 mg, per mole of silver halide in the silver halide emulsion. The sensitizing dyes can be incorporated in a structural element of the photosensitive material, particularly in a silver halide emulsion, by a conventional method. For example, a sensitizing dye is dissolved in an organic solvent compatible with water, such as acetone, methanol, ethanol, propanol, methylcellosolve, pyridine or dimethylformamide, and the resulting solution is incorporated in an emulsion. In another process, a sensitizing dye is dissolved in a volatile organic solvent, the resulting solution is dispersed in a hydrophilic colloid and the dispersion is added to an emulsion (U.S. Pat. No. 3,469,987). Also, there can be mentioned processes disclosed in U.S. Pat. Nos. 2,912,345, 2,996,287, 3,342,605 and 3,425,835. The sensitizing dye can be incorporated in the emulsion at any time before the application of the photosensitive material to the base. It is convenient to effect the incorporation prior to the application thereof to the base. The sensitizing dye can also be incorporated in a structural element of the photosensitive material after it is dissolved in an organic solvent together with a compound of above general formula (I) or a salt thereof.

The term "structural element" herein means a silver halide photographic emulsion layer and non-photosensitive layers (such as top layer, filter layer and intermediate layer) of the photosensitive material. Thus, according to the present invention, a compound of above formula (I) or a salt thereof, and a sensitizing dye of formula (II) can be incorporated in at least one of those elements, preferably the silver halide photographic emulsion.

As the silver halide emulsion used in the photodevelopable silver halide photosensitive material of the present invention, there can be used any of silver bromide emulsion, silver chloride-bromide emulsion, silver chloride-iodide-bromide emulsion and silver-iodide-bromide emulsion. Emulsions containing more than 90 molar %, based on the total halogens, of bromine are suitable. Particularly, internal latent image emulsions are preferred. The silver halide emulsion can be obtained by mixing a soluble silver salt solution, such as aqueous silver nitrate solution, with a halide solution, such as potassium bromide solution, in the presence of a hydrophilic protective colloid and physically ripening the mixture to obtain particles of a suitable size. The physical ripening is preferably effected under acidic conditions of below pH 5, particularly below pH 3.0. As acids used for obtaining acidic conditions, there can be used hydrochloric acid and nitric acid.

As the protective colloids, there can be mentioned, for example, gelatin and gelatin derivatives, such as phthalic gelatin and succinic gelatin, albumin, collodion, acacia, agar, alginic acid, cellulose derivatives, such as alkyl esters of carboxycellulose, hydroxyethylcellulose, and carboxymethylcellulose, and synthetic resins, such as polyvinyl alcohol, polyvinyl pyrrolidone, polyacrylic acid and ethyl acrylate copolymers. They can be used either alone or in the form of a mixture thereof.

The emulsion can be prepared in the presence of a suitable solvent for silver halide such as organic thioether compounds, for example, 1,8-dihydroxy-3,6-dithiaoctane disclosed in U.S. Pat. No. 3 271 157 or an alkali thiocyanate disclosed in U.S. Pat. No. 3,260,605 in order to promote the growth of particles and to obtain uniform particles. Contrast of the resulting photosensitive material can be improved by effecting the physical ripening in the presence of a water-soluble lead salt.

The photodevelopable silver halide photosensitive material of the present invention can contain a suitable gelatin hardening agent, gelatin plasticizer or coating aid.

The photodevelopable silver halide photosensitive material of the present invention can be applied to a base selected from a broad range of conventional bases. As suitable bases, there can be mentioned paper, baryta paper, polyethylene, polystyrene, polycarbonate, nitrocellulose, acetylcellulose, synthetic paper, glass, paper coated with polyethylene or the like and metal sheets.

The photodevelopable silver halide photosensitive material of the present invention can be subjected to the usual wet development and fixing treatment, if necessary. For example, the usual wet development and fixing treatment can be effected after the formation of a latent image by short time high illumination exposure or, alternatively, after the formation of a visible image by low illumination exposure following said first exposure, whereby to obtain a light-stable image which can be maintained permanently.

The following examples further illustrate the present invention.

EXAMPLE 1

An aqueous silver nitrate solution and an aqueous alkali halide solution containing potassium bromide and sodium chloride were added dropwise simultaneously and slowly to a dilute aqueous gelatin solution which had been made acidic (pH 3.0) with nitric acid in the presence of 3 molar %, based on the silver nitrate, of 1,8-dihydroxy-3,6-dithiaoctane and 0.5 molar % of lead nitrate to obtain a silver chloride-bromide (95 molar % silver bromide and 5 molar % of silver chloride) emulsion.

Then, the resulting emulsion was cooled and the water-soluble salts were removed. An additional amount of the aqueous gelatin solution was added thereto so that the weight ratio of gelatin to silver nitrate would be 80:100. The mixture was divided into 7 equal portions. One portion was taken as blank (control) sample. Various amounts of compound (1) as shown in following Table 1, were added to the other portions to obtain samples of the present invention. Those samples were adjusted to have a gelatin concentration of 6%, and were applied to a 110 g/m$^2$ non-baryta paper so that the amount of silver at the application time was 3.0 g/m$^2$ and then the coated papers were dried.

The samples were exposed to a high intensity light through a wedge tablet (Photographic tablet No. 2; a product of Eastman Kodak Co.) of a density difference of 0.15 for $10^{-5}$ sec. with an Edgerton, Germeshausen and Grier Mark VI sensitometer. Then, light development was effected with an illumination of 500 lux with 20 W white luminescent lamp for 5 minutes. The sensitivity of the resulting image, the maximum density ($D_{max.}$), the minimum density ($D_{min.}$) and the contrast ($\Delta D = D_{max.} - D_{min.}$) were determined. The sensitivity was determined from the number of visible steps of said tablet and the density was determined with a reflection densitometer. The results are shown in Table 1.

TABLE 1

| Test No. | Amount of above compound (1) (molar % based on silver nitrate) | Sensitivity (number of steps) | D max | D min | Δ D |
|---|---|---|---|---|---|
| 1 (Blank) | 0.0 | 14 | 0.21 | 0.15 | 0.06 |
| 2 | 0.1 | 16 | 0.30 | 0.15 | 0.15 |
| 3 | 0.3 | 16.5 | 0.39 | 0.15 | 0.24 |
| 4 | 0.5 | 16.5 | 0.44 | 0.15 | 0.29 |
| 5 | 1.0 | 16.5 | 0.46 | 0.15 | 0.31 |
| 6 | 2.0 | 16 | 0.47 | 0.15 | 0.32 |
| 7 | 5.0 | 15.5 | 0.46 | 0.16 | 0.30 |

It is apparent from Table 1 that if a relatively small amount of a halogen acceptor of the present invention is used, the sensitivity and contrast can be improved remarkably.

EXAMPLE 2

A silver chloride-bromide emulsion prepared in the same manner as described in Example 1 was divided into equal portions. 0.5 Molar %, based on the silver nitrate, of a halogen acceptor, as listed in the following Table 2, was added thereto and samples were prepared in the same manner as described in Example 1 and same were subjected to the same measurements. The results are shown in Table 2.

TABLE 2

| Test No. | Halogen acceptor (0.5 molar % based on silver nitrate) | Sensitivity (Number of steps) | D max. | D min. | Δ D |
|---|---|---|---|---|---|
| 8 | Above mentioned compound (3) | 17 | 0.47 | 0.15 | 0.32 |
| 9 | 2-Thiouracil | 15 | 0.20 | 0.16 | 0.04 |
| 10 | 1-Phenyl-5-mercapto-tetrazole | 15 | 0.19 | 0.15 | 0.04 |
| 11 | Ethylenethiourea | 15.5 | 0.25 | 0.17 | 0.08 |
| 12 | 1-n-Propylhexa-hydro-S-triazine-4-thione | 15.5 | 0.24 | 0.17 | 0.07 |
| 13 | Dithiourazole | 15.5 | 0.28 | 0.17 | 0.11 |
| 14 | Rhodanine | 15 | 0.25 | 0.19 | 0.06 |
| 15 | 2-Mercapto-thiazoline | 15 | 0.26 | 0.18 | 0.08 |
| 16 | 1,3-Diethyl-thiourea | 15 | 0.24 | 0.16 | 0.08 |
| 17 | 4-Phenyl-3-thio-semicarbazide | 13 | 0.26 | 0.17 | 0.09 |
| 18 | 5-Amino-2-mer-capto-1,3,4-thiadiazole | 15.5 | 0.30 | 0.18 | 0.12 |

It is apparent from the above table that a very excellent light-development effect was obtained in the test (Test No. 8) wherein a compound according to the present invention was used, whereas a light-development effect was hardly obtained in the tests (Tests Nos. 9–18) wherein known halogen acceptors were used in a small amount of 0.5 molar %, based on the silver nitrate.

EXAMPLE 3

A silver chloride-bromide emulsion prepared in the same manner as described in Example 1 was divided into equal portions. 1.0 Molar %, based on the silver nitrate, of a halogen acceptor according to the present invention, as listed in Table 3, was added thereto and samples were prepared in the same manner as described in Example 1 and same were subjected to the same measurements. The results are shown in Table 3.

TABLE 3

| Test No. | Halogen acceptor (1.0 molar % based on silver nitrate) | Sensitivity (number of steps) | D max | D min | Δ D |
|---|---|---|---|---|---|
| 19 | Above compound (3) | 17.5 | 0.53 | 0.17 | 0.36 |
| 20 | Above compound (5) | 17.5 | 0.53 | 0.18 | 0.35 |
| 21 | Above compound (6) | 17.5 | 0.56 | 0.18 | 0.38 |
| 22 | Above compound (7) | 17 | 0.52 | 0.17 | 0.35 |
| 23 | Above compound (9) | 16.5 | 0.51 | 0.17 | 0.34 |
| 24 | Above compound (10) | 17 | 0.50 | 0.17 | 0.33 |

EXAMPLE 4

The light development-type photosensitive materials used in Example 3 were exposed to a light of high intensity with Visigraph FR-102 (a direct recording type electromagnetic oscillograph: a product of San'ei Sokuki Co.) under conditions of an amplitude of 4 cm, a frequency of 100 c/s and a feeding rate of 1 m/sec. Then, it was exposed to a light of 500 lux with a 20 W white luminescent lamp for 5 minutes to render the trace visible. In all cases, a dark blue trace appeared on a cream-colored background several seconds after the light-development. After 5 minutes, a clear recorded image of a high contrast was obtained.

Those images were then wet-developed according to the following recipe. As a result, black traces on a stainless background were obtained in all cases. They had a high contrast and were completely stable against light.

| Treatment | Treatment temperature | Treatment time |
|---|---|---|
| 1. Development | 20° C. | 1 min. 30 sec.–2 mins. |
| 2. Fixing | 20° C. | longer than 2 mins. |
| 3. Washing with water | 20° C. | longer than 10 mins. |

In the development treatment, the following developing solution was used:

| Developing solution: | |
|---|---|
| Hydroquinone | 6 g |
| p-Methylaminophenol sulfate | 6 g |
| 1-Phenyl-3-pyrazolidone | 0.2 g |
| Anhydrous sodium sulfite | 50 g |
| Sodium carbonate monohydrate | 50 g |
| 1-Phenyl-5-mercaptotetrazole | 0.5 g |
| Potassium bromide | 1 g |
| Boric acid | 10 g |
| Potassium thiocyanate | 2 g |
| Water | ad 2 liters |

In the fixing treatment, the following fixing solution was used.

| Fixing solution: | |
|---|---|
| Anhydrous sodium thiosulfate | 320 g |
| Anhydrous sodium sulfite | 30 g |
| Acetic acid | 60 ml |
| Boric acid | 15 g |
| Potassium alum | 40 g |
| Water | ad 2 liters |

EXAMPLE 5

An aqueous silver nitrate solution and an aqueous alkali halide solution containing potassium bromide and sodium chloride were added dropwise simultaneously and slowly to a dilute aqueous gelatin solution which had been made acidic (pH 3.0) with nitric acid in the presence of 3 molar %, based on the silver nitrate, of 1,8-dihydroxy-3,6-dithiaoctane and 0.5 molar % of lead nitrate to obtain a silver chloride-bromide (95 molar % silver bromide and 5 molar % of silver chloride) emulsion.

Then, the resulting emulsion was cooled and water-soluble salts were removed. An additional amount of the aqueous gelatin solution was added thereto so that weight ratio of gelatin to silver nitrate would be 80:100. 170 Milligrams, per mole of silver halide, of a sensitizing dye shown in Table 4 were added thereto and the mixture was divided into 8 equal portions. 0.5 Molar %, based on the silver halide, of 2,5-dimercapto-1,3,4-thiadiazole shown above was added to each portion to obtain samples of the present invention (Samples Nos. 26–31) and comparative samples (Samples Nos. 32–33). Another comparative sample (Sample No. 34) was also used which was prepared in the same manner as the above samples, except that the halogen acceptor was replaced with an equal amount of 2-thiouracil and the same amount of comparative dye C shown below was used as sensitizing dye. A blank sample (Sample No. 25) was the same as the sample of the present invention but it contained no sensitizing dye.

Each of the samples was controlled to a gelatin concentration of 6% and then applied to a 110 g/m$^2$ non-baryta base paper in such a manner that the amount of silver applied was 3.0 g/m$^3$. It was then dried.

The samples were exposed to a high intensity light through a wedge tablet (Photographic tablet No. 2; a product of Eastman Kodak Co.) of a density difference of 0.15 for $10^{-5}$ sec. with xenon flash lamp. Then, light-development was effected with an illumination of 500 lux with 20 W white luminescent lamp for 5 minutes. The sensitivity of the resulting image, the maximum density ($D_{max.}$), the minimum density ($D_{min.}$), the contrast ($\Delta D = D_{max.} - D_{min.}$) and the color stain were determined. As to the sensitivity, the total sensitivity and the minus blue sensitivity were measured. The total sensitivity was determined from the number of visible steps to light of the whole wavelength range of the xenon flash light with Kodak Photographic Step Tablet No. 2. The minus blue sensitivity was determined from the number of visible steps obtained when blue light range of xenon flash lamp was cut out with a Kodak Wratten Filter No. 16. The density was measured with a reflection type densitometer. The degree of color stain was examined macroscopically and shown by four rating criteria of "high", "medium", "low" and "none", wherein "high" indicates a remarkable color stain, "medium" indicates a relatively medium color stain, "low" indicates a small color stain and "none" indicates that no color stain was observed macroscopically. Comparative dyes A, B and C were the following sensitizing dyes:

Comparative dye A:

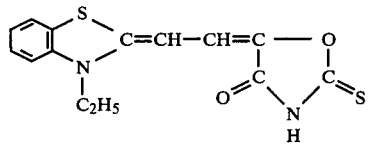

Comparative dye B:

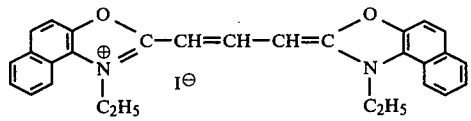

Comparative dye C:

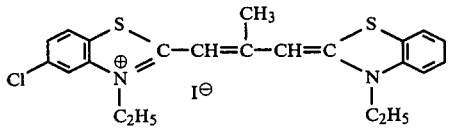

TABLE 4

| Sample No. | Halogen acceptor | Sensitizing dye | Total sensitivity (number of steps) | Minus blue sensitivity (number of steps) | D max | D min | Δ D | Color stain |
|---|---|---|---|---|---|---|---|---|
| 25 (Blank) | 2,5-Dimercapto-1,3,4-thiadiazole | None | 16.5 | 0 | 0.44 | 0.15 | 0.29 | None |
| 26 | 2,5-Dimercapto-1,3,4-thiadiazole | Dye (1) | 20.0 | 15.0 | 0.64 | 0.30 | 0.34 | None |
| 27 | 2,5-Dimercapto-1,3,4-thiadiazole | Dye (8) | 20.0 | 15.5 | 0.66 | 0.31 | 0.35 | None |
| 28 | 2,5-Dimercapto-1,3,4-thiadiazole | Dye (13) | 21.0 | 16.0 | 0.63 | 0.31 | 0.32 | None |
| 29 | 2,5-Dimercapto-1,3,4-thiadiazole | Dye (18) | 20.5 | 16.0 | 0.63 | 0.32 | 0.31 | None |
| 30 | 2,5-Dimercapto-1,3,4-thiadiazole | Dye (27) | 20.0 | 15.0 | 0.61 | 0.30 | 0.31 | None |
| 31 | 2,5-Dimercapto-1,3,4-thiadiazole | Dye (28) | 20.0 | 15.0 | 0.60 | 0.30 | 0.30 | None |
| 32 | 2,5-Dimercapto-1,3,4-thiadiazole | Comparative dye A*1 | 18.0 | 11.0 | 0.51 | 0.31 | 0.20 | Medium |
| 33 | 2,5-Dimercapto-1,3,4-thiadiazole | Comparative dye B*1 | 18.5 | 11.5 | 0.54 | 0.33 | 0.21 | High |
| 34 | 2-Thiouracil (for comparison) | Comparative dye C*1 | 18.0 | 10.0 | 0.45 | 0.35 | 0.10 | High |

EXAMPLE 6

200 Milligrams, per mole of silver nitrate, of a sensitizing dye, the above Dye No. (2), were incorporated in silver chloride-bromide emulsion prepared in the same manner as described in Example 5. The emulsion was divided into equal portions. Each portion was incorporated with 0.5 molar %, based on the silver halide, of a halogen acceptor, as listed in Table 5, to obtain samples. The samples were subjected to the exposure and the measurement in the same manner as described in Example 5. The results are shown in Table 5.

TABLE 5

| Sample No. | Halogen acceptor | Total sensitivity (number of steps) | Minus blue sensitivity (number of steps) | D max | D min | Δ D | Color stain |
|---|---|---|---|---|---|---|---|
| 35 | Above | 20.5 | 16.0 | 0.66 | 0.30 | 0.36 | None |
| 36 | Above compound (5) | 21.0 | 16.0 | 0.66 | 0.31 | 0.35 | None |
| 37 | Above compound (6) | 20.5 | 16.0 | 0.69 | 0.31 | 0.38 | None |
| 38 | Above compound (7) | 20.5 | 15.5 | 0.68 | 0.30 | 0.38 | None |
| 39 | Above compound (9) | 20.0 | 15.0 | 0.67 | 0.30 | 0.37 | None |
| 40 | Above compound (10) | 20.5 | 15.5 | 0.64 | 0.28 | 0.36 | None |
| 41 | 1,3-Diethylthiourea | 18.5 | 11.0 | 0.50 | 0.32 | 0.18 | Medium |
| 42 | 1-Phenyl-5-mercaptotetrazole | 19.0 | 13.0 | 0.51 | 0.32 | 0.19 | High |
| 43 | Ethylenethiourea | 18.0 | 8.5 | 0.55 | 0.35 | 0.20 | High |
| 44 | Zinc diethyldithiocarbamate | 17.5 | 10.5 | 0.64 | 0.39 | 0.25 | Medium |
| 45 | 3,5-Dithiourazole | 19.0 | 13.0 | 0.59 | 0.38 | 0.24 | High |
| 46 | Rhodanine | 18.5 | 12.5 | 0.53 | 0.36 | 0.17 | High |
| 47 | Thiomalic acid | 17.5 | 9.0 | 0.51 | 0.27 | 0.24 | Medium |
| 48 | Stannous chloride | 19.5 | 13.5 | 0.65 | 0.40 | 0.25 | High |
| 49 | 4-Phenylthiosemicarbazide | 18.5 | 6.5 | 0.52 | 0.34 | 0.18 | High |
| 50 | 5-Amino-2-mercapto-1,3,4-thiadiazole | 19.5 | 13.5 | 0.59 | 0.32 | 0.27 | Medium |

EXAMPLE 7

The photodevelopable light development-type silver halide photosensitive material used in Sample 35 in Example 6 was exposed to a light of high intensity with a direct recording type electromagnetic oscillograph in which a xenon lamp was used, under conditions of an amplitude of 4 cm, a frequency of 100 C/S and a feeding rate of 1 m/sec. Then, it was exposed to a light of 500 lux with a 20 W white luminescent lamp for 5 minutes to render the trace visible. In all cases, a dark blue trace appeared on a cream-colored background several seconds after the light development. After 5 minutes, a clear recording image of a high contrast was obtained.

Those images were wet-developed according to the following recipe. As a result, black traces on a stainless background were obtained in all cases. They had a high contrast and were completely stable against light.

| Treatment | Treatment temperature | Treatment time |
|---|---|---|
| 1. Development | 20° C. | 1 min. 30 sec.–2 mins. |
| 2. Fixing | 20° C. | longer than 2 mins. |
| 3. Washing with water | 20° C. | longer than 10 mins. |

In the development treatment, the following developing solution was used:

| Developing solution: | |
|---|---|
| Hydroquinone | 6 g |
| p-Methylaminophenol sulfate | 6 g |
| 1-Phenyl-3-pyrazolidone | 0.2 g |
| Anhydrous sodium sulfite | 50 g |
| Sodium carbonate monohydrate | 50 g |
| 1-Phenyl-5-mercaptotetrazole | 0.5 g |
| Potassium bromide | 1 g |
| Boric acid | 10 g |
| Potassium thiocyanate | 2 g |
| Water | ad 2 liters |

In the fixing treatment, the following fixing solution was used:

| Fixing solution: | |
|---|---|
| Anhydrous sodium thiosulphate | 320 g |
| Anhydrous sodium sulfite | 30 g |
| Acetic acid | 60 ml |
| Boric acid | 15 g |
| Potassium alum | 40 g |
| Water | ad 2 liters |

The embodiments of the invention in which an exclusive property or privilege is claimed are defined as follows:

1. In a photodevelopable silver halide photosensitive material wherein a visible image is formed by a latent image-forming step in which high intensity light exposure is effected for a short time and then a subsequent light development step is effected using low intensity light exposure, the improvement which comprises: said photosensitive material contains, as a halogen acceptor, from 0.3 to 2.0 molar %, based on the silver halide, of one or a mixture of two or more compounds of the formula

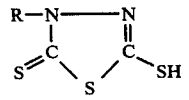

wherein $R_1$ is hydrogen, lower alkyl, unsubstituted aryl or substituted aryl, and salts thereof.

2. A photodevelopable silver halide photosensitive material according to claim 1 wherein the molar ratio of bromine to other halogens in the silver halides is at least 90 molar %.

3. A photodevelopable silver halide photosensitive material according to claim 1 or claim 2 wherein said halogen acceptor is 2,5-dimercapto-1,3,4-thiadiazole.

4. A photodevelopable silver halide photosensitive material according to claim 1 or claim 2 wherein said halogen acceptor material is a dialkali metal salt of 2,5-dimercapto-1,3,4-thiadiazole.

5. A photodevelopable silver halide photosensitive material according to claim 1 or claim 2 wherein said halogen acceptor material is bis-(1,8-diazabicyclo[5,4,0]-undecene-7) salt of 2,5-dimercapto-1,3,4-thiadiazole.

6. A photodevelopable silver halide photosensitive material according to claim 1 or claim 2 wherein said halogen acceptor material is mono-(1,8-diazabicyclo[5,4,0]-undecene-7) salt of 2,5-dimercapto-1,3,4-thiadiazole.

7. A photodevelopable silver halide photosensitive material according to claim 1 or claim 2 wherein the silver halide photosensitive material is a photosensitive material for oscillographic recording.

8. A photodevelopable silver halide photosensitive material according to claim 1 wherein the latent image-forming step comprises high intensity exposure for $10^{-1}$ to $10^{-6}$ second.

9. A photodevelopable silver halide photosensitive material wherein a visible image is formed by a latent image-forming step wherein high intensity light exposure is effected for a short time and then a subsequent light development step is effected using low intensity light exposure, the improvement which comprises: an element of said photosensitive material contains, as a halogen acceptor, from 0.3 to 2.0 molar %, based on the silver halide, of one or a mixture of two or more compounds having the formula

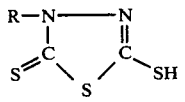

wherein $R_1$ is hydrogen, lower alkyl, unsubstituted aryl or substituted aryl, and also contains one or a mixture of two or more sensitizing dyes having the formula

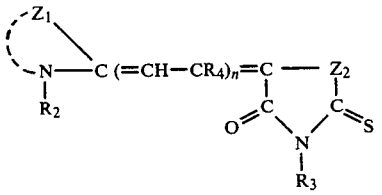

wherein

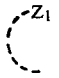

is a non-metal atomic group that completes a five-membered or six-membered heterocyclic ring, $Z_2$ is sulfur or $>NR_5$, wherein $R_5$ is hydrogen, substituted alkyl, unsubstituted alkyl, unsubstituted aryl or substituted aryl, $R_2$ is substituted alkyl or unsubstituted alkyl, $R_3$ is substituted alkyl, unsubstituted alkyl, unsubstituted aryl, substituted aryl, alkenyl or hydrogen, $R_4$ is hydrogen, alkyl, unsubstituted aryl or substituted aryl, and n is a number of 0, 1 or 2.

10. A photodevelopable silver halide photosensitive material according to claim 9 wherein the molar ratio of bromine to other halogens in the silver halides is at least 90 molar %.

11. A photodevelopable silver halide photosensitive material according to claim 9 or claim 10 wherein said halogen acceptor material is 2,5-dimercapto-1,3,4-thiadiazole.

12. A photodevelopable silver halide photosensitive material according to claim 9 or claim 11 wherein said halogen acceptor material is a dialkali metal salt of 2,5-dimercapto-1,3,4-thiadiazole.

13. A photodevelopable silver halide photosensitive material according to claim 9 or claim 11 wherein said halogen acceptor material is bis-(1,8-diazabicyclo[5,4,0]-undecene-7) salt of 2,5-dimercapto-1,3,4-thiadiazole.

14. A photodevelopable silver halide photosensitive material according to claim 9 wherein

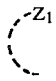

is a nonmetallic atomic group that completes a hetero ring selected from the group consisting of substituted or unsubstituted benzoxazole ring, benzothiazole ring, benzoselenazole ring, naphthoxazole ring, naphthothiazole ring, naphthoselenazole ring, oxazole ring, thiazole ring, indole ring and 2-quinaline.

15. A photodevelopable silver halide photosensitive material according to claim 14 wherein said sensitizing dye is 3-ethyl-5[(3-ethyl-2-benzothiazolinylidene)ethylidene]-rhodanine.

16. A photodevelopable silver halide photosensitive material according to claim 14 wherein said sensitizing dye is triethylamine salt of 3-ethyl-5-{[1-(3-sulfopropyl)-2-naphtho[1,2-d]-oxazolinylidene]ethylidene}-rhodanine.

17. A photodevelopable silver halide photosensitive material according to claim 14 wherein said sensitizing dye is triethylamine salt of 1-phenyl-3-n-octyl-5-{[1-(3-sulfopropyl)-2-naphtho-[1,2-d]-thiazolinylidene]ethylidene}-2-thiohydantion.

18. A photodevelopable silver halide photosensitive material of according to claim 9 or claim 17 wherein the photodevelopable silver halide photosensitive material is a photosensitive material for oscillographic recording.

19. A photodevelopable silver halide photosensitive material according to claim 9 wherein the latent image-forming step comprises high intensity exposure for $10^{-1}$ to $10^{-6}$ second.

* * * * *

UNITED STATES PATENT OFFICE

CERTIFICATE OF CORRECTION

Patent No. 4 252 895 Dated February 24, 1981

Inventor(s) Masahiro Kato et al

It is certified that error appears in the above-identified patent and that said Letters Patent are hereby corrected as shown below:

Column 17, line 3; delete "material".

Column 17, line 7; delete "material".

Column 17, line 12; delete "material".

Column 18, line 13; delete "material".

Column 18, line 16; change "claim 11" to ---claim 10---.

Column 18, line 17; delete "material".

Column 18, line 20; change "claim 11" to ---claim 10---.

Column 18, line 21; delete "material".

Column 18, line 37; change "2-quinaline" to ---2-quinoline---.

Column 18, line 51; change "thiohydantion" to ---thiohydantoin---.

Column 18, line 53; change "claim 17" to ---claim 15---.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*